US006557178B1

(12) United States Patent
Hoover

(10) Patent No.: US 6,557,178 B1
(45) Date of Patent: May 6, 2003

(54) VERSATILE SANDING GLOVE

(76) Inventor: Bruce G. Hoover, 17252 Big Rd., Bloxom, VA (US) 23308

( * ) Notice: Subject to any disclaimer, the term of this patent is extended or adjusted under 35 U.S.C. 154(b) by 0 days.

(21) Appl. No.: 10/208,268

(22) Filed: Jul. 30, 2002

(51) Int. Cl.[7] ..... A41D 19/00

(52) U.S. Cl. ..... 2/161.6; 2/160; 2/918; 15/227

(58) Field of Search ..... 2/160, 161.6, 163, 2/918, 16, 20; 15/227; 473/59, 60

(56) References Cited

U.S. PATENT DOCUMENTS

| | | | | |
|---|---|---|---|---|
| 3,643,368 A | | 2/1972 | Grzyll | |
| 3,748,792 A | | 7/1973 | Lamb | |
| 3,789,555 A | | 2/1974 | Means | |
| 3,885,249 A | | 5/1975 | DeBrabander | |
| 4,621,338 A | | 11/1986 | Ortolivo | |
| 5,003,637 A | | 4/1991 | London | |
| 5,642,527 A | | 7/1997 | Savage | |
| 5,800,446 A | | 9/1998 | Banuchi | |
| 5,885,148 A | | 3/1999 | Vargas et al. | |
| 5,956,770 A | * | 9/1999 | Dennis | 2/160 |
| 6,018,837 A | * | 2/2000 | Andreu | 15/118 |
| 6,098,234 A | * | 8/2000 | Jackson, Jr. | 15/118 |
| 2002/0009966 A1 | | 1/2002 | Orr | |

FOREIGN PATENT DOCUMENTS

| | | | | |
|---|---|---|---|---|
| CA | 2092843 | | 9/1994 | |
| CA | 2117830 | | 7/1996 | |
| EP | 0594095 A1 | | 4/1994 | |
| FR | 2588728 | | 4/1987 | |
| GB | 2078091 | * | 1/1982 | ..... A41D/19/00 |
| GB | 2143720 A | | 2/1985 | |
| GB | 2260889 A | | 5/1993 | |
| GB | 2368776 A | | 5/2002 | |

* cited by examiner

*Primary Examiner*—John J. Calvert
*Assistant Examiner*—Katherine Moran
(74) *Attorney, Agent, or Firm*—Miller Patent Services; Jerry A. Miller

(57) ABSTRACT

A sanding glove device for carrying a loop backed sanding pad of any desired shape. A soft leather glove has a thumb compartment, an index finger compartment, a middle finger compartment, a ring finger compartment and a small finger compartment, each of the finger compartments having palm sides and back sides and fingertip ends, and a main opening for insertion of a user's hand. Each of the index, middle and ring finger compartments have a strip of hook fastener material attached to the palm side and the back side thereof. The thumb compartment and the small finger compartment are devoid of strips of hook fastener material so that the loop backed sanding pad of any desired shape can be attached to at least one of the strips of hook fastener material to facilitate sanding. The thumb and small finger compartments are free of hook fastener material to facilitate the user's ability to grip and manipulate objects without removal of the glove.

25 Claims, 5 Drawing Sheets

VERSATILE SANDING GLOVE

FIELD OF THE INVENTION

This invention relates generally to the field of sanding a workpiece such as wood. More particularly, this invention in certain embodiments relates to a versatile glove to which abrasives can be attached in many configurations to facilitate sanding.

BACKGROUND OF THE INVENTION

Among the more difficult and tiring jobs associated with woodworking are the sanding and finishing jobs. Such jobs have been aided by use of power sanding devices, but almost invariably, some amount of hand sanding is generally needed in any quality sanding job.

In order to properly sand a given workpiece while retaining crisp detail lines and smooth scratchless contours, often the person doing the sanding must carefully devise various shapes of sandpaper and sanding blocks to properly conform to various shapes and details. Otherwise, fine details can be destroyed in the sanding process. Gripping sanding blocks, sanding sticks, sanding pads and individual pieces of sandpaper can fatigue the hand and fingers and be extremely tiresome as the woodworker carries out the sanding process through multiple grades of abrasive to achieve a quality smooth surface that is free of sanding marks.

In order to assist in this sanding process, several types of sanding gloves have been devised. In some designs, an abrasive is permanently attached to the glove. This permits the user to carry out certain sanding operations without the need for constantly gripping sandpaper, sanding pads, sanding blocks or sanding sticks. Unfortunately, such devices are more costly than sandpaper and only carry one grade of abrasive. Additionally, such gloves are limited in their applicability due to the user's inability to manipulate the shape of the abrasive beyond that of the gloved hand.

In other designs, various mechanisms have been devised to provide for attachment of sandpaper to the glove using hook and loop fasteners and the like. However, existing designs have not met with commercial acceptance. In one such design, the hook and loop fastening materials covers an entire palm side of a mitten style glove. Such designs are deficient in that they permit the user's hand to move somewhat freely within the glove. This is undesirable in the sanding process since the desire is for the glove to remain stationary with respect to the hand and move in relation to the workpiece. In other designs, the palm side of the glove is fitted with hook and loop fastening materials on all four fingers, the palm and the thumb. This design leads to a costly glove that is subject to wear on any parts of the hook and loop fastening material that are not fully covered with an abrasive. Both of these designs are deficient in that they significantly inhibit the user from freely using the gloved hand to pick up and manipulate objects without removal of the glove. This is because the hook and loop fasteners used on such gloves has a slick surface that sticks to mating material but provides little friction for non-mating materials. Additionally, the addition of such hook and loop fastener material to a glove reduces the user's ability to flex the glove easily to facilitate manipulation of objects.

SUMMARY OF THE INVENTION

The present invention relates generally to a versatile sanding glove. Objects, advantages and features of the invention will become apparent to those skilled in the art upon consideration of the following detailed description of the invention.

In one embodiment, a sanding glove consistent with embodiments of present invention is made up of a soft leather glove that has a thumb compartment, an index finger compartment, a middle finger compartment, a ring finger compartment and a small finger compartment, each of the finger compartments having palm sides and back sides and fingertip ends, and a main opening for insertion of a user's hand. Each of the index, middle and ring finger compartments have a strip of hook fastener material attached to the palm side and the back side thereof. The thumb compartment and the small finger compartment are devoid of strips of hook fastener material so that the loop backed sanding pad of any desired shape can be attached to at least one of the strips of hook fastener material to facilitate sanding. The thumb and small finger compartments are free of hook fastener material (or are omitted entirely) to facilitate the user's ability to grip and manipulate objects without removal of the glove.

The above summary is intended to describe an exemplary embodiment of the invention, which will be best understood in conjunction with the detailed description to follow. This summary is not intended to limit the scope of the appended claims.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description of the invention, which describes certain exemplary embodiments of the invention, taken in conjunction with the accompanying drawings in which:

DETAILED DESCRIPTION OF THE INVENTION

Figure 2:
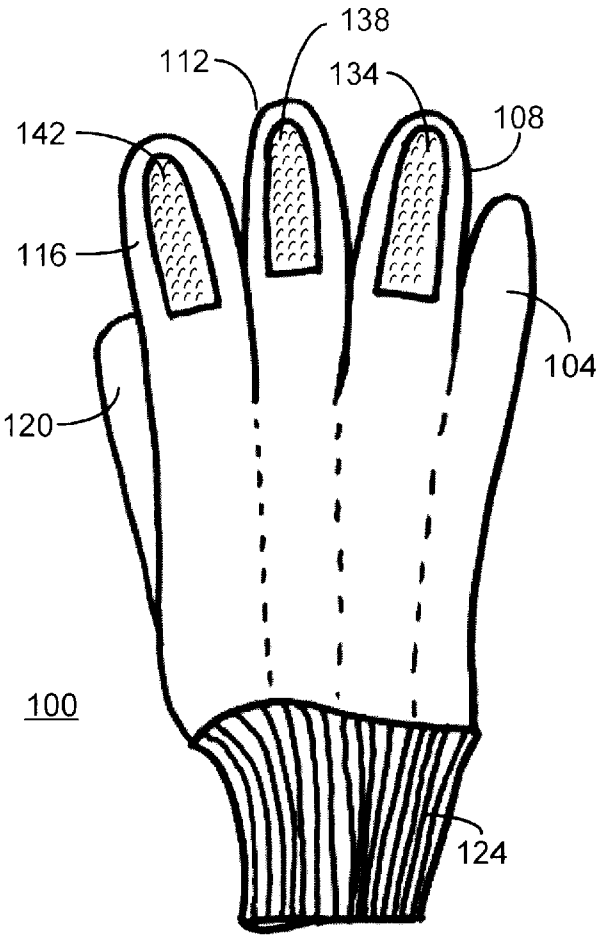
FIG. 2 is a back side view of a sanding glove device consistent with certain embodiments of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings.

Figure 1:
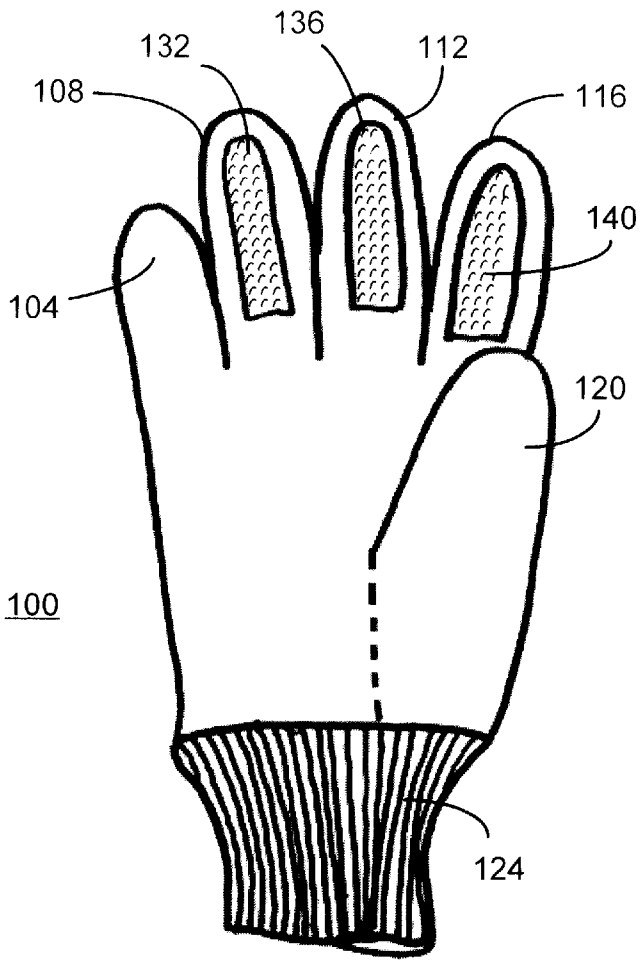
FIG. 1 is a palm side view of a sanding glove device consistent with certain embodiments of the present invention.

Turning now to FIG. 1, viewed in conjunction with FIG. 2, a palm side and a back side respectively of a versatile sanding glove 100 consistent with certain embodiments of the present invention is illustrated. This embodiment of the sanding glove has four finger compartments, namely—small finger compartment 104, ring finger compartment 108, middle finger compartment 112 and index finger compartment 116 and a thumb compartment 120 with each of the finger compartments and thumb compartments having a palm side and a back side. The glove has a main opening at the bottom for insertion of the user's hand. In the embodiment illustrated, a woven fabric stretchable wrist band 124 is sewn around the main opening to provide a seal to inhibit debris from entering the inside of the glove when the glove is in use.

The present illustration shows a right-handed glove 100, but a left handed glove or even an ambidextrous embodiment can be produced without departing from the present invention. In the preferred embodiment, the sanding glove 100 is produced in both right and left-handed models to permit the user to select one or both for a good fit and to permit sanding with either or both hands as desired.

In order to attach abrasive sanding materials to the glove 100, each of three finger compartments (ring finger compartment 108, middle finger compartment 112 and index finger compartment 116) in the present embodiment are provided with strips of loop fastener material on both the palm side and the back side thereof. The loop fastener material can be, for example, Velcro® brand hook and loop fastener material (Velcro® is a registered trademark of Velcro USA Inc., 406 Brown Avenue, Manchester, N.H. 03103 for its brand of hook and loop fasteners.) Numerous types of hook and loop fasteners are available. In the preferred embodiment, Velcro® brand hook and loop fastener material from the ULTRA-MATE® series 705, type HTH Hook 22 is utilized in ⅝ inch strips. This type of hook fastener material is made of a nylon copolymer that is similar to woven nylon and is readily sewn. This type of material was selected to provide ease of separation of the hooks from the loops while simultaneously providing high shear strength to prevent the fasteners from separating while in use. Ring finger compartment 108 has a palm side hook fastener strip 132 and a back side hook fastener strip 134. Middle finger compartment 112 has a palm side hook fastener strip 136 and a back side hook fastener strip 138. Index finger compartment 116 has a palm side hook fastener strip 140 and a back side hook fastener strip 142. Each of the hook fastener strips are preferably between approximately 1.0 and 2½ inches in length (preferably 2¼ to 2⅛ inches) and approximately ½ to ¾ inch wide (preferably approximately ⅝ inch wide). Equivalently, multiple segments of hook fastener material can be used to make up the strip with a small gap (e.g., ⅛ inch) at approximately the finger joint. Other dimensions and shapes are possible. In other embodiments, other arrangements of the back side hook fastener strips are possible using more or fewer strips.

In the present embodiment, hook fastener strips are not provided on the thumb compartment 120 and small finger compartment 104 since it has been found that such strips add little if any versatility to the sanding glove. In fact, they have been found to be a disadvantage in many respects since they inhibit movement, increase cost and simply wear down if not covered with sandpaper. Moreover, it is often necessary to pick up and otherwise manipulate tools and other objects in the course of sanding work. By leaving the thumb and at least one finger free of the hook fastener strip, objects (e.g., sanding pads and small tools) can be readily gripped and otherwise manipulated using the opposing forces of the thumb and finger without need for removal of the glove and without being encumbered by the properties of the hook fastener material when attempting to manipulate objects. Known sanding gloves appear to have been designed to maximize the amount of hook fastener material on the glove, when in fact, only a relatively small amount as shown is needed to securely hold a sanding pad. More than is required for holding the sanding pad merely serves to make to glove less flexible and more difficult to manipulate objects without removal of the glove. Of course, this ability to readily manipulate objects without removal of the glove provides for increased efficiency since the glove normally can be left in place for longer periods of time without wasting time taking the glove off and putting it back on.

Additionally, if the hook fastener material is exposed during the sanding process, it is subject to wear. This suggests that any excess fastener material should be covered with sanding pads in order to prevent excess wear. This further limits the use of such gloves to manipulate objects without removal of the glove. Since the addition of hook fastener strips where not needed merely increases cost without significant benefit, and further since they detract from a user's ability to manipulate objects without removal of the glove, they are omitted from the preferred embodiment illustrated. While it is preferred that the thumb and small finger be free of the hook fastener material, the thumb along with another finger could also be used without departing from the invention. Moreover, in other embodiments, the thumb compartment 120 and small finger compartment 104 could be omitted to permit the user to have direct skin contact with objects being manipulated, without departing from the invention. The embodiment illustrated, however, provides protection for the thumb and small finger while permitting the thumb and small finger to move freely for manipulation of objects. The palm is also preferably devoid of any hook fastener material to permit the hand to flex freely and provide additional hand surface to assist in manipulation of objects.

Figure 3:
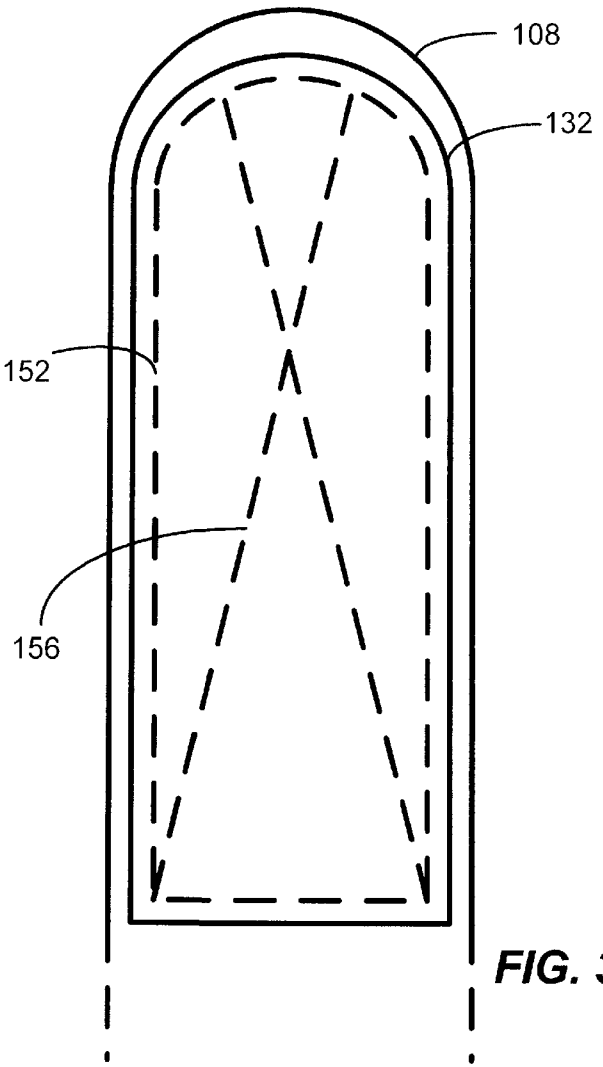
FIG. 3 illustrates a sewing pattern used in one embodiment consistent with the present invention.

FIG. 3 illustrates a preferred sewing pattern used to attach the hook fastener strips to the finger compartments, with finger compartment 108 and hook fastener strip 132 being shown as exemplary. The hook fastener strip 132 is substantially rectangular extending from near the fingertip downward through two finger joints to end between the second joint and the knuckle. The hook fastener strip 132 is substantially rectangular with a rounded tip to conform with the fingertip of the glove. The hook fastener strip 132 is secured around its periphery with stitching 152 and is secured though its center with an X-shaped stitch pattern 156. This arrangement has been found to securely hold the hook fastener strips to the finger compartments through many hours of use.

The glove itself is preferably manufactured of soft leather such as napa leather or goat leather which has been treated to make it soft and pliable. In order to prevent the glove from sliding around on the hand of the user, it is best that the glove fit snugly over the user's hand and fingers. Thus, various sizes are preferably provided to assure a proper fit of glove to hand and fingers.

Sandpaper pads having mating loop fastener material on the back side thereof of any desired configuration can be affixed to the glove either using the hook fastener strips on the front or the back of the finger compartments or both to provide a versatile sanding mechanism. Additionally, it has been found that abrasive scour pads such as Scotch-Brite® (Scotch-Brite is a trademark of 3M Corporation) brand scour pads will adhere to the hook fastener strips to permit their use for polishing and abrasion operations. Such pads have been found extremely useful for buffing between finish coats on a finished wood surface. Other materials such as abranet ™ brand abrasives manufactured by Mirka Abrasives, Inc., 7950 Bavaria Road, Twinsburg, Ohio 44087 (an abrasive pad with a screen-like surface) have also been found to stick to the hook fastener strips and can be used in conjunction with the present sanding glove.

For purposes of this document, and in particular in the claims, the term "sanding pad" is often used as a generic for any abrasive device that can be attached to the sanding glove 100 in order to avoid the need to redundantly list the various types of abrasives that might be attached. This includes, but is not limited to, sanding pads per se, sanding discs, sandpaper, sanding cloth, user fabricated sanding devices, scour pads, etc. Moreover, the term "sanding pad" can be interpreted to be the equivalent of a conversion pad with an attached abrasive portion, be it paper, cloth, sanding pad, etc. It is believed that it will be clear whether the term is being used in a generic sense or to explicitly refer to a sanding pad per se.

Figure 4:
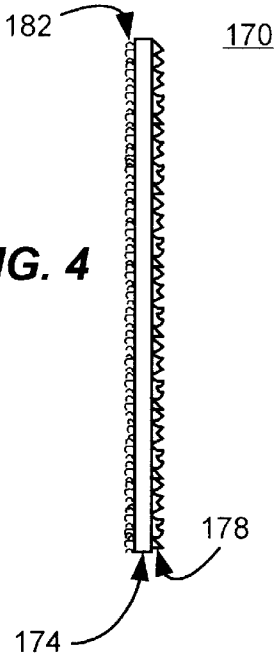
FIG. 4 is a cross sectional view of sanding pad suitable for used with certain embodiments of the present invention.

An exemplary rectangular sanding pad is illustrated in cross section in FIG. 4. Sanding pad 170 has a base material or substrate 174 which might be a paper, cloth, foam, composite or other suitable material. Abrasive particles 178 such as silicon carbide, garnet, aluminum oxide or other abrasive particles are bonded to the substrate 174, generally using a glue or resin. Other sanding pads use a sandwich of foam between other substrates such as paper or cloth to facilitate bonding of abrasive on one side and loop fasteners on the other. Such a sanding pad (of any desired shape) can be used in conjunction with the glove 100 of the present invention by simply mating the loop fastener side of the sanding pad 170 to any or all of the hook fastener strips 132, 136 and 140, and/or hook fastener strips 134, 138 and 142. This permits the user to hold the sandpaper in place without having to using opposing force of the thumb permitting easy and less fatiguing sanding.

Figure 5:
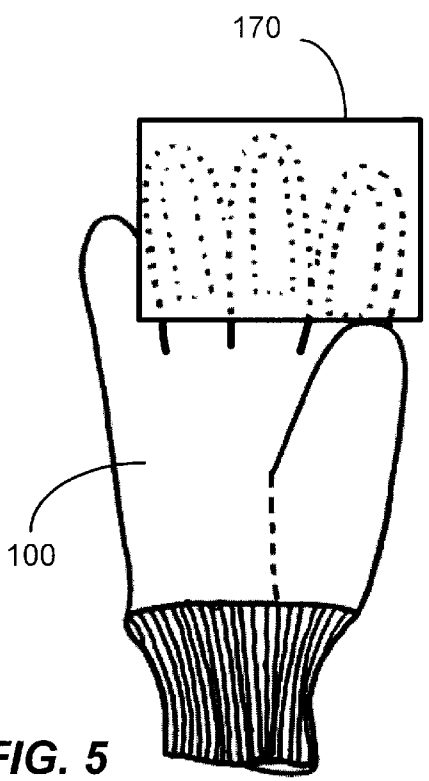
FIG. 5 illustrates a rectangular sanding pad spanning multiple finger segments consistent with certain embodiments of the present invention.
Figure 6:
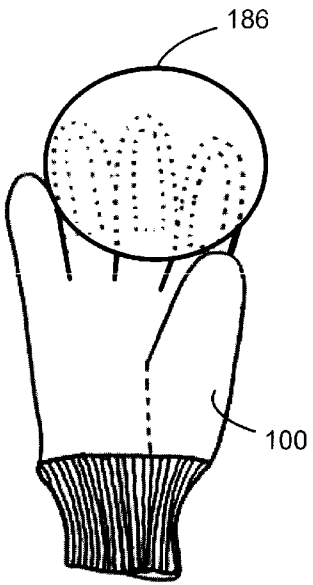
FIG. 6 illustrates a round sanding pad spanning multiple finger segments consistent with certain embodiments of the present invention.

FIG. 5 illustrates how a rectangular shaped sanding pad such as 170 can be attached to the hook fastener strips. In this example, sanding pad 170 is attached to hook fastener strips 132, 136 and 140. The user can then sand any desired shape that the fingers will conform to while being free of need to grip the sandpaper while carrying out the sanding operation. In a similar manner, any other suitable shape of sanding pad can be attached to one or more of the hook fastener strips as illustrated by the round pad 186 attached to hook fastener strips 132, 136 and 140 of FIG. 6. The ability to attach pads as desired to one or more of the hook fastener strips permits the user the advantage of customizing the sanding pad to the shape to be sanded. It is common to provide such custom shaping in hand sanding operations, however, without use of a sanding glove as disclosed herein, such custom shapes were held in place while sanding using substantial opposing force between the thumb and at least one finger causing unnecessary fatigue, especially on the fingers and hands.

Figure 7:
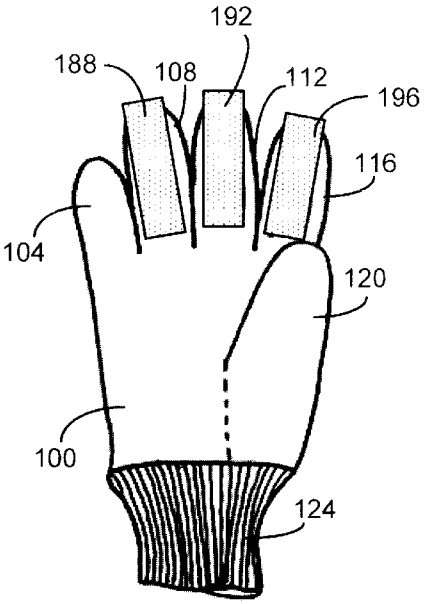
FIG. 7 illustrates use of multiple sanding pads on multiple finger segments in a manner consistent with certain embodiments of the present invention.

FIG. 7 illustrates three sanding pads 188, 192 and 196 attached to finger compartments 108, 112 and 116 respectively by attachment to hook fastener strips 132, 136 and 140 respectively. In this configuration, the fingers are free to move independently of one another as required to facilitate sanding a workpiece.

Figure 9:
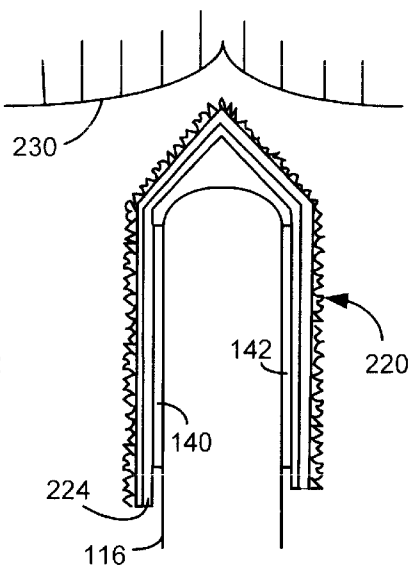
FIG. 9 illustrates another sanding pad wrapped around a single finger to attach to palm side and back side finger segments in a manner consistent with certain embodiments of the present invention.
Figure 8:
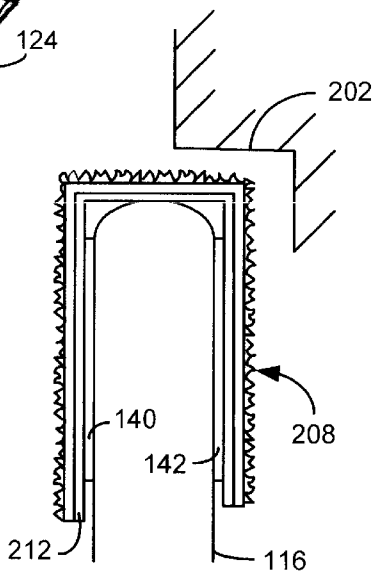
FIG. 8 illustrates a sanding pad wrapped around a single finger to attach to palm side and back side finger segments in a manner consistent with certain embodiments of the present invention.

Heretofore, the sanding pads have been illustrated as attached to the palm side of the glove 100. However, in some instances, it may be desirable to utilize both the palm side and the back side hook fastener strips to secure a sanding pad in a desired shape around the fingertips. In the simplest example, the sanding pad can simply be wrapped around from front to back (or back to front) to conform with the fingertip. This can provide the advantage of having multiple curvatures with which to sand in order to mate with various workpiece shapes. One example is a concave curve on the outer lip of a hollow turned vessel. In other examples, more crisply defined shapes can be sanded using the sanding glove of the present invention. One such example is illustrated in FIG. 8 in which a sharp square edge of a workpiece 202. In this example, the finger compartment 116 with hook fastener strips 140 and 142 is attached to a rectangular segment of sanding pad 208 by loop fastener layer 212. In a similar manner, FIG. 9 illustrates a rectangular segment of sandpaper 220 is attached with hook fastener layer 224 to finger compartment 116 and shaped with a pointed end adjacent the fingertip to fit within the contour of a cove in workpiece 230. Of course, one skilled in the art will appreciate upon consideration of this material that sanding pads 208 and 220 should be relatively rigid in construction to provide the appropriate backing for sanding in these configurations.

In addition to the above, sanding pads of any desired shape can be attached to the back side hook fasteners 134, 138 and/or 142 alone to permit the user to carry out sanding operations while applying pressure from the palm side of the hand toward the back side of the hand. This permits the user, in some instances, to alternate between back side to palm side and palm side to back side pressure, further minimizing fatigue (especially on the fingers and hands) in the sanding process.

Figure 11:
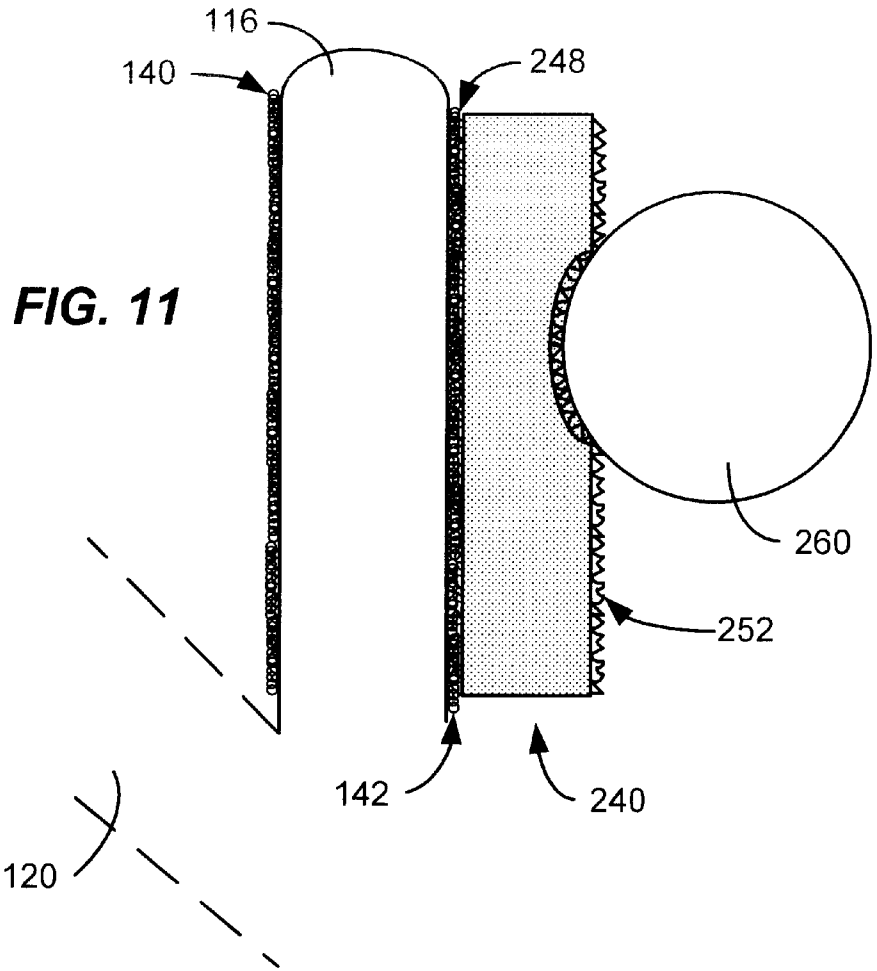
FIG. 11 is a side view of a cushioned sanding pad in use sanding a round surface consistent with certain embodiments of the present invention.
Figure 10:
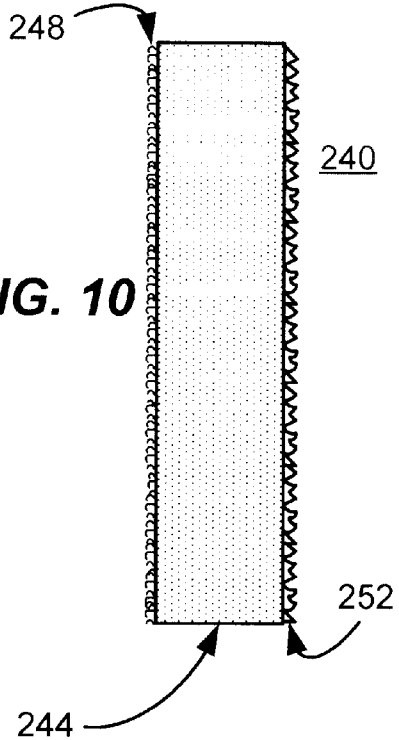
FIG. 10 is a cross sectional view of a cushioned sanding pad suitable for use with certain embodiments of the present invention.

Other sanding operations can be carried out using cushioned sanding pads such at the pad illustrated as 240 of FIG. 10. Such sanding pads incorporate a pliable cushion 244 such as foam rubber and similar materials between the hook fasteners 248 on one surface and the abrasive material 252 on the opposing surface. Such sanding pads are commercially available from several manufacturers, one example being Mirka Abrasives, Inc.'s Abralon™ brand sanding pads. Such sanding pads tend to conform to the shape of the object being sanded. This provides a larger area of contact with the sandpaper and distributes the sanding force over a wider area. This is illustrated in connection with the side view of FIG. 11 in which the sanding pad 240 is attached to the back side of sanding glove 100. In this side view, the pad's connection to back side hook fastener strip 142 can be seen (with connection to other back side hook fastener strips 138 and 134 hidden from view, if present). In this case a circular workpiece 260 is shown to deform the sanding pad 240 during the sanding operation. In this type of application, the user can alternate attachment of the sanding pad between the palm side and the back side to further reduce fatigue.

Figure 13:
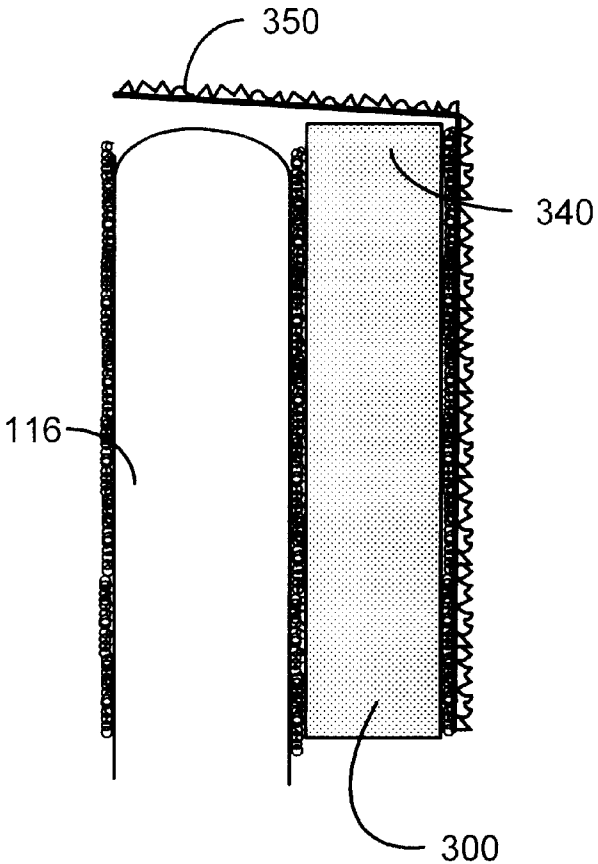
FIG. 13 is a cross sectional view of the conversion pad of FIG. 12 used with the sanding glove in a manner consistent with certain embodiments of the present invention.
Figure 12:
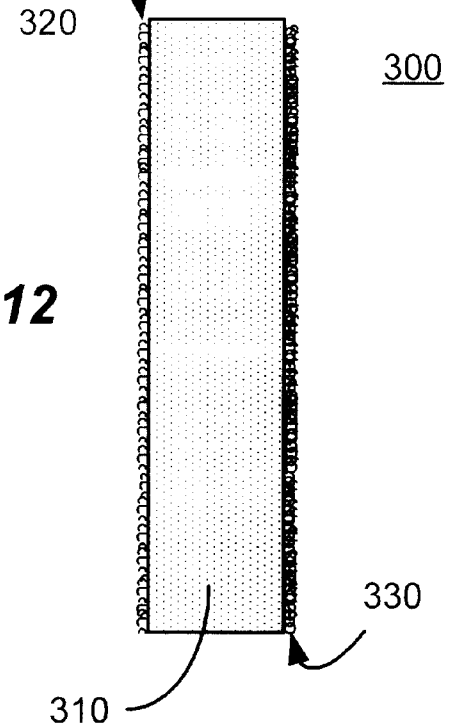
FIG. 12 is a cross sectional view of a conversion pad suitable for use with certain embodiments of the present invention.

FIG. 12 illustrates a commercially available conversion pad 300 which is suitable for use in conjunction with the present invention. Conversion pad 300 has a foam (or other material) core 310 and is available in varying thicknesses and firmnesses. One side of the conversion pad 300 carries hook fasteners 320 and the other carries loop fasteners 330. Such conversion pads are generally sold in three inch and five inch diameters. In use, they can be attached at the loop side to the hook fastener strips of the glove 100 and to a segment of sandpaper on the hook side. Such conversion pads can be used in their original shape or can easily be shaped with a sharp knife or scissors to any other desired shape. One shape that has been found particularly useful in detail sanding is a "D" shape used in conjunction with a rigid conversion pad. This is, of course, easily achieved by cutting a straight cut across the round conversion disk. Once this D shaped conversion pad is fabricated, it can be utilized as illustrated in FIG. 13.

Conversion pad 300 is attached to the sanding glove at either the back side or the palm side with the flat portion of the D shape 340 placed adjacent to the fingertips of the glove. A segment of sandpaper 350 can then be attached to the conversion pad 300 as illustrated so that it extends beyond the flat portion of the D shape and in fact folds over the edge of the conversion pad 300. This produces a squared off edge of sandpaper that is useful for sanding detailed internal corners without softening the desired lines. Additional support for the conversion pad and sandpaper can be obtained by light pressure on the lower portion of the conversion pad applied by the thumb. This creates a lever action that supports the pad firmly to inhibit wobbling of the pad. Since the thumb has no hook fastener material, it is not subject to wear from contact with the abrasive. Additionally, the curved side of the D-shape is useful in sanding various shapes including larger diameter interior curves. Those skilled in the art will appreciate that there are infinite possibilities for creation of sanding pads in this manner to accomplish particular tasks.

Although not illustrated, another useful way to utilize the sanding glove 100 is by wrapping a segment of sandpaper or sanding disk (a three inch diameter sanding disk has been found particularly suitable) around the finger so that it completely encompasses the finger except at the fingertip. This can then be used to sand the interior of an orifice such as the interior mouth of a hollow turned vessel. Numerous other configurations will occur to those skilled in the art in light of the present teaching.

Those skilled in the art will also appreciate in light of this teaching that in addition to the use of commercial conversion pads, such pads can be readily fabricated by sandwiching a substrate material of a desired shape (e.g., wood) between a layer of hook fastener on one surface and loop fastener on the other surface. This permits the user to fabricate any desired shape of sanding block to assist in sanding surfaces of any shape.

The user will often notice that a heightened sense of feel is achieved in using the sanding glove 100 of the present invention. Apparently, this heightened sense of feel is the result of not needing to apply a gripping force to the sanding pad. An enhanced sense of feel inherently leads to a better sanding job, since touch is often the best judge of the quality of certain aspects of a sanding job. This is achieved with an overall lower level of fatigue, especially on the fingers and hands.

Those skilled in the art will understand that the present invention has been described in an embodiment wherein the glove is outfitted with hook fastener strips in order to mate the glove to sanding pads with loop fasteners. This is considered advantageous since most known commercially available hook and loop compatible sanding pads are outfitted with the loop side of the fastener material. However, this should not be considered limiting, since the opposite configuration would be equivalently functional and is considered fully equivalent. Sanding pads and sandpaper as described herein should be interpreted to mean any pad or other substrate which can be used abrasively to cut, sand, polish or grind cut a surface. The illustrated embodiment utilizes a stretchable woven fabric to fabricate wrist band 124, but the wrist band could be omitted or other mechanisms could be employed to keep debris out of the glove. One common technique to accomplish this is to use a wrist strap with a buckle fastener or a hook and loop fastener arrangement to securely close the opening at the wrist. Such arrangements are also consistent with contemplated embodiments. Additionally, the exact shape and arrangement and mechanism for connection to the glove of the hook fastener strips should not be limited except as claimed.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A sanding glove device for carrying a loop backed sanding pad of any desired shape, comprising:

a glove having a thumb compartment, an index finger compartment, a middle finger compartment, a ring finger compartment and a small finger compartment, each of the finger compartments having palm sides and back sides and fingertip ends, and a main opening for insertion of a user's hand;

a first strip of hook fastener material attached to the palm side of the index finger compartment;

a second strip of hook fastener material attached to the palm side of the middle finger compartment;

a third strip of hook fastener material attached to the palm side of the ring finger compartment;

a fourth strip of hook fastener material attached to the back side of the index finger compartment;

a fifth strip of hook fastener material attached to the back side of said middle finger compartment; and a sixth strip of hook fastener material attached to the back side of said ring finger compartment, wherein the thumb compartment and the small finger compartment are devoid of strips of hook fastener material, whereby, the loop backed sanding pad of any desired shape can be attached to at least one of the strips of hook fastener material to facilitate sanding.

2. The apparatus according to claim 1, wherein the first, second, third, fourth, fifth and sixth strips of hook fastener material are positioned adjacent the finger tips and extending along the finger compartments.

3. The apparatus according to claim 2, wherein the strips of hook fastener material are curved at a fingertip end thereof to approximately conform to the finger compartments.

4. The apparatus according to claim 1, wherein the first, second, third, fourth, fifth and sixth strips of hook fastener material are approximately 1 to 2½ inches in length and approximately ½ to ¾ inch wide.

5. The apparatus according to claim 1, further comprising a woven fabric wrist band attached to the main opening.

6. The apparatus according to claim 1, further comprising a D-shaped conversion pad attached to at least one of the strips of hook fastener material on a loop fastener side thereof, and a segment of abrasive material attached to the conversion pad on a hook fastener side thereof.

7. The apparatus according to claim 1, wherein the glove has a palm portion and wherein the palm portion is devoid of hook fastener material.

8. The apparatus according to claim 1, wherein the glove is made of soft leather.

9. A sanding glove device for carrying a loop backed sanding pad of any desired shape, comprising:

a glove having an index finger compartment, a middle finger compartment and a ring finger compartment, each of the finger compartments having palm sides and back sides and fingertip ends, and a main opening for insertion of a user's hand;

a first strip of hook fastener material attached to the palm side of the index finger compartment;

a second strip of hook fastener material attached to the palm side of the middle finger compartment;

a third strip of hook fastener material attached to the palm side of the ring finger compartment; and at least a fourth strip of hook fastener material attached to the back side of at least one of the index finger compartment, the middle finger compartment and the ring finger compartment, wherein the glove is otherwise devoid of hook fastener material, whereby, the loop backed sanding pad of any desired shape can be attached to at least one of the strips of hook fastener material to facilitate sanding.

10. The apparatus according to claim 9, wherein the first, second, third, and fourth strips of hook fastener material are positioned adjacent the finger tips and extending along the finger compartments.

11. The apparatus according to claim 10, wherein the strips of hook fastener material are curved at a fingertip end thereof to approximately conform to the finger compartments.

12. The apparatus according to claim 11, wherein the strips of hook fastener material are attached to the finger compartments by sewing around a periphery of the strips and sewing an X-shape through a center portion thereof.

13. The apparatus according to claim 9, wherein the first, second, third and fourth strips of hook fastener material are approximately 1 to 2½ inches in length and approximately ½ to ¾ inch wide.

14. The apparatus according to claim 9, further comprising a woven fabric wrist band attached to the main opening.

15. The apparatus according to claim 9, further comprising a D-shaped conversion pad attached to at least one of the strips of hook fastener material on a loop fastener side thereof, and a segment of abrasive material attached to the conversion pad on a hook fastener side thereof.

16. The apparatus according to claim 9, wherein the glove is made of soft leather.

17. A sanding glove device for carrying a loop backed sanding pad of any desired shape, comprising:

a glove having a thumb compartment, an index finger compartment, a middle finger compartment, a ring finger compartment and a small finger compartment, each of the finger compartments having palm sides and back sides and fingertip ends, and a main opening for insertion of a user's hand;

a first strip of hook fastener material attached to the palm side of the index finger compartment;

a second strip of hook fastener material attached to the palm side of the middle finger compartment; and a third strip of hook fastener material attached to the palm side of the ring finger compartment;

at least a fourth strip of hook fastener material attached to the back side of at least one of the index finger compartment, the middle finger compartment and the ring finger compartment, wherein the thumb compartment and the small finger compartment are devoid of hook fastener material, whereby, the loop backed sanding pad of any desired shape can be attached to at least one of the strips of hook fastener material to facilitate sanding.

18. The apparatus according to claim 17, wherein the first, second, third, and fourth strips of hook fastener material are positioned adjacent the finger tips and extending along the finger compartments and wherein the strips of hook fastener material are curved at a fingertip end thereof to approximately conform to the finger compartments.

19. The apparatus according to claim 17, further comprising a wrist band attached to the main opening.

20. The apparatus according to claim 17, wherein the glove is made of soft leather.

21. A sanding glove device for carrying a loop backed sanding pad of any desired shape, comprising:

a glove having at least three of an index finger compartment, a middle finger compartment, a ring finger compartment and a small finger compartment, each of the finger compartments having palm sides and back sides and fingertip ends, and a main opening for insertion of a user's hand;

three strips of hook fastener material attached to the palm side of three of the finger compartments; and at least a fourth strip of hook fastener material attached to the back side of at least one of the finger compartments;

wherein the a thumb compartment if present and a fourth of the finger compartments if present are devoid of hook fastener material, whereby, the loop backed sanding pad of any desired shape can be attached to at least one of the strips of hook fastener material to facilitate sanding.

22. The apparatus according to claim 21, wherein the three strips of hook fastener material are positioned adjacent the finger tips and extending along the finger compartments.

23. The apparatus according to claim 21, further comprising a wrist band attached to the main opening.

24. The apparatus according to claim 17, wherein the glove is made of soft leather.

25. A sanding glove device, comprising:

a glove made of soft leather and having a palm portion, a thumb compartment, an index finger compartment, a middle finger compartment, a ring finger compartment and a small finger compartment, each of the finger compartments having palm sides and back sides and fingertip ends, and a main opening for insertion of a user's hand;

a first strip of hook fastener material sewn to the palm side of the index finger compartment;

a second strip of hook fastener material sewn to the palm side of the middle finger compartment;

a third strip of hook fastener material sewn to the palm side of the ring finger compartment;

a fourth strip of hook fastener material sewn to the back side of the index finger compartment;

a fifth strip of hook fastener material sewn to the back side of said middle finger compartment;

a sixth strip of hook fastener material sewn to the back side of said ring finger compartment, wherein the strips of hook fastener material are made of a nylon copolymer;

a woven fabric wrist band attached to the main opening;

a D-shaped rigid conversion pad attached to at least one of the strips of hook fastener material on a loop fastener side thereof, and a segment of abrasive material attached to the conversion pad on a hook fastener side thereof;

wherein the palm portion, the thumb compartment and the small finger compartment are devoid of strips of hook fastener material, wherein the first, second, third, fourth, fifth and sixth strips of hook fastener material are curved at a fingertip end thereof to approximately conform to the finger compartments and are positioned adjacent the finger tips and extend along the finger compartments, wherein the first, second, third, fourth, fifth and sixth strips of hook fastener material are approximately 1 to 2½ inches in length and approximately ½ to ¾ inch wide.

* * * * *